US012478187B2

(12) United States Patent
Liu et al.

(10) Patent No.: US 12,478,187 B2
(45) Date of Patent: Nov. 25, 2025

(54) PIVOTALLY MOUNTED CUPHOLDER ASSEMBLY FOR A POWERED CHAIR OR OTHER FURNITURE PIECE

(71) Applicant: MOTOMOTION CHINA CORPORATION, Changzhou (CN)

(72) Inventors: Chih Hsiung Liu, Benoni (ZA); Hai Guo Jiang, Changzhou (CN)

(73) Assignee: MOTOMOTION CHINA CORPORATION, Changzhou (CN)

( * ) Notice: Subject to any disclaimer, the term of this patent is extended or adjusted under 35 U.S.C. 154(b) by 166 days.

(21) Appl. No.: 18/228,964

(22) Filed: Aug. 1, 2023

(65) Prior Publication Data

US 2025/0040718 A1 Feb. 6, 2025

(51) Int. Cl.
*A47C 7/62* (2006.01)

(52) U.S. Cl.
CPC ..... *A47C 7/624* (2018.08); *A47C 7/622* (2018.08)

(58) Field of Classification Search
CPC ..... A47C 7/622; A47C 1/035; A47C 7/624
USPC ..... 297/188.14–188.21; 248/311.2
See application file for complete search history.

(56) References Cited

U.S. PATENT DOCUMENTS

| | | | | |
|---|---|---|---|---|
| 8,307,966 | B2 * | 11/2012 | Cummins | A47C 7/70 297/188.06 X |
| 8,544,945 | B2 * | 10/2013 | King | A47C 1/121 297/188.14 X |
| 9,655,458 | B2 * | 5/2017 | Jacobs | A47C 1/121 |
| 9,730,518 | B1 * | 8/2017 | Jacobs | A47C 7/70 |
| 11,439,242 | B1 * | 9/2022 | Norton | A47C 7/624 |
| 2014/0159437 | A1 * | 6/2014 | Humphreys | A47C 1/0342 297/78 |
| 2015/0353200 | A1 * | 12/2015 | Thomaschewski | B60N 3/102 297/188.21 |

FOREIGN PATENT DOCUMENTS

| | | | | |
|---|---|---|---|---|
| CN | 215225529 U | * | 12/2021 | A47C 7/622 |

* cited by examiner

*Primary Examiner* — Rodney B White
(74) *Attorney, Agent, or Firm* — LAW OFFICES OF STEVEN W. WEINRIEB

(57) ABSTRACT

A new and improved cupholder assembly, to be mounted within a powered furniture piece which is capable of being moved from an upright position to an inclined position, comprises a cupholder housing, a cupholder pivotally attached to the cupholder housing, and a counterweight fixedly attached to the cupholder. When the furniture piece is moved to the inclined position, the counterweight will maintain the cupholder at a vertical orientation such that a beverage, contained within a beverage cup which is disposed within the cupholder, will not be spilled.

11 Claims, 4 Drawing Sheets

PIVOTALLY MOUNTED CUPHOLDER ASSEMBLY FOR A POWERED CHAIR OR OTHER FURNITURE PIECE

FIELD OF THE INVENTION

The present invention relates generally to powered chairs or similar furniture pieces, and more particularly to a pivotally mounted cupholder assembly for use within a powered chair or furniture piece such that when the powered chair or furniture piece is moved from an upright position to an inclined or reclined position, a cupholder, disposed within the cupholder assembly built into, for example, an arm portion of the chair or furniture piece, will remain vertically oriented whereby drinks or other liquids, disposed within a beverage cup disposed within the cupholder, will not spill as the arm portion of the chair or furniture piece is tilted to a predetermined angle as the powered chair or furniture piece is inclined or reclined.

BACKGROUND OF THE INVENTION

Powered chairs, or other powered furniture pieces, are of course well-known, wherein various sections of the chair or furniture piece will undergo movements such that, for example, the chair or furniture piece can attain any one of a multitude of positions, such as, for example, an upright position, an inclined position, a reclined position, and the like. As is very often the case, such chairs, which are commonly used within residential entertainment rooms or home offices, as well as within business conference rooms or offices, are usually equipped with cupholders such that an occupant of the chair or other furniture piece may drink his or her favorite beverage while occupying the chair when reading, or watching a movie or TV show, or conducting a business presentation, or, alternatively, conducting a personal or business conference. It has been experienced, however, that, if, while using the chair for one of the aforenoted purposes, the occupant has placed a beverage cup within one of the powered chair cupholders, and should the chair be moved to the inclined or reclined position, then the arm portion of the powered chair, within which the cupholder and the beverage cup is disposed, will likewise be inclined. Still further, if the beverage cup is full, or substantially full, then when the powered chair, and the arm or armrest portion thereof, is inclined, the beverage, disposed within the beverage cup which was placed within the cupholder, may inadvertently spill out from the beverage cup. Obviously, such an occurrence is not at all desirable for any one of a multitude of reasons, one being the fact that such a beverage spill is messy or untidy, necessitating that the mess or spill be cleaned up. Secondly, the occupant of the chair may need to change his or her clothes since the spilled beverage may have rendered the person's clothes wet and uncomfortable. Thirdly, the need to clean up the mess or spill, or to change clothes, interrupts the event in which the person was participating, that is, reading, watching TV or a movie, conducting a business presentation, or conducting a personal or business conference.

A need therefore exists in the art for a new and improved cupholder assembly. Another need exists in the art for a new and improved cupholder assembly for use within a powered piece of furniture. Still another need exists in the art for a new and improved cupholder assembly for use within a powered chair. Yet another need exists in the art for a new and improved cupholder assembly for use within a powered chair wherein the cupholder assembly, disposed within an arm or armrest portion of the powered chair, will effectively counteract the inclined disposition of the cupholder assembly, disposed within an arm portion of the powered chair, when the powered chair is moved to its inclined or reclined position. Still yet another need exists in the art for a new and improved cupholder assembly for use within a powered chair wherein the cupholder assembly, disposed within an arm or armrest portion of the powered chair, will effectively counteract the inclined disposition of the cupholder assembly, disposed within an arm or armrest portion of the powered chair, when the powered chair is moved to its inclined or reclined position, by effectively maintaining the cupholder of the cupholder assembly in a vertical mode despite the inclination of the powered chair, the arm or armrest portion thereof, and the cupholder assembly disposed within the arm or armrest portion of the powered chair. Yet still another need exists in the art for a new and improved cupholder assembly for use within a powered chair wherein the cupholder assembly, disposed within an arm or armrest portion of the powered chair, will effectively counteract the inclined disposition of the cupholder assembly, disposed within an arm or armrest portion of the powered chair, when the powered chair is moved to its inclined or reclined position, by effectively maintaining the cupholder of the cupholder assembly in a vertical mode despite the inclination of the powered chair, the arm or armrest portion thereof, and the cupholder assembly disposed within the arm or armrest portion of the powered chair, whereby the contents of a beverage cup, disposed within the cupholder, will effectively be prevented from spilling.

OVERALL OBJECTIVES OF THE INVENTION

An overall objective of the present invention is to provide a new and improved cupholder assembly. Another overall objective of the present invention is to provide a new and improved cupholder assembly for use within a powered piece of furniture. Still another overall objective of the present invention is to provide a new and improved cupholder assembly for use within a powered chair. Yet another overall objective of the present invention is to provide a new and improved cupholder assembly for use within a powered chair wherein the cupholder assembly, disposed within an arm or armrest portion of the powered chair, will effectively counteract the inclined disposition of the cupholder assembly, disposed within an arm or armrest portion of the powered chair, when the powered chair is moved to its inclined or reclined position. Still yet another overall objective of the present invention is to provide a new and improved cupholder assembly for use within a powered chair wherein the cupholder assembly, disposed within an arm or armrest portion of the powered chair, will effectively counteract the inclined disposition of the cupholder assembly, disposed within an arm or armrest portion of the powered chair, when the powered chair is moved to its inclined or reclined position, by effectively maintaining the cupholder of the cupholder assembly in a vertical mode despite the inclination of the powered chair, the arm or armrest portion thereof, and the cupholder assembly disposed within the arm portion of the powered chair. Yet still another overall objective of the present invention is to provide a new and improved cupholder assembly for use within a powered chair wherein the cupholder assembly, disposed within an arm or armrest portion of the powered chair, will effectively counteract the inclined disposition of the cupholder assembly, disposed within an arm or armrest portion of the powered chair, when the powered chair is moved to its inclined or reclined position, by effectively maintaining the cupholder of the cupholder assembly in a vertical mode despite the inclination of the powered chair, the arm or armrest portion thereof, and the cupholder assembly disposed within the arm or armrest portion of the powered chair, whereby the contents of a beverage cup, disposed within the cupholder, will effectively be prevented from spilling.

SUMMARY OF THE INVENTION

The foregoing and other objectives are achieved by the new and improved cupholder assembly, developed in accordance with the principles and teachings of the present invention, wherein the new and improved cupholder assembly is seen to comprise a cupholder mount or housing which is adapted to be fixedly mounted within an arm or armrest portion of a powered chair or other furniture piece, and wherein a cupholder is pivotally mounted upon the cupholder mount or housing. The cupholder is provided with a counterweight and is adapted to receive a beverage cup. Accordingly, when the powered chair or other powered furniture piece is inclined, such as, for example, when the powered chair or furniture piece is moved from its normal upright position to an inclined or reclined position, the arm or armrest portion of the powered chair or furniture piece, and the cupholder mount fixedly mounted within the arm or armrest portion of the chair or furniture piece, will likewise be inclined, however, the counterweight of the cupholder will effectively cause or force the cupholder to maintain a vertical orientation whereby the beverage cup, disposed within the cupholder, will likewise maintain a vertical orientation such that the contents of the beverage cup will not be spilled.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
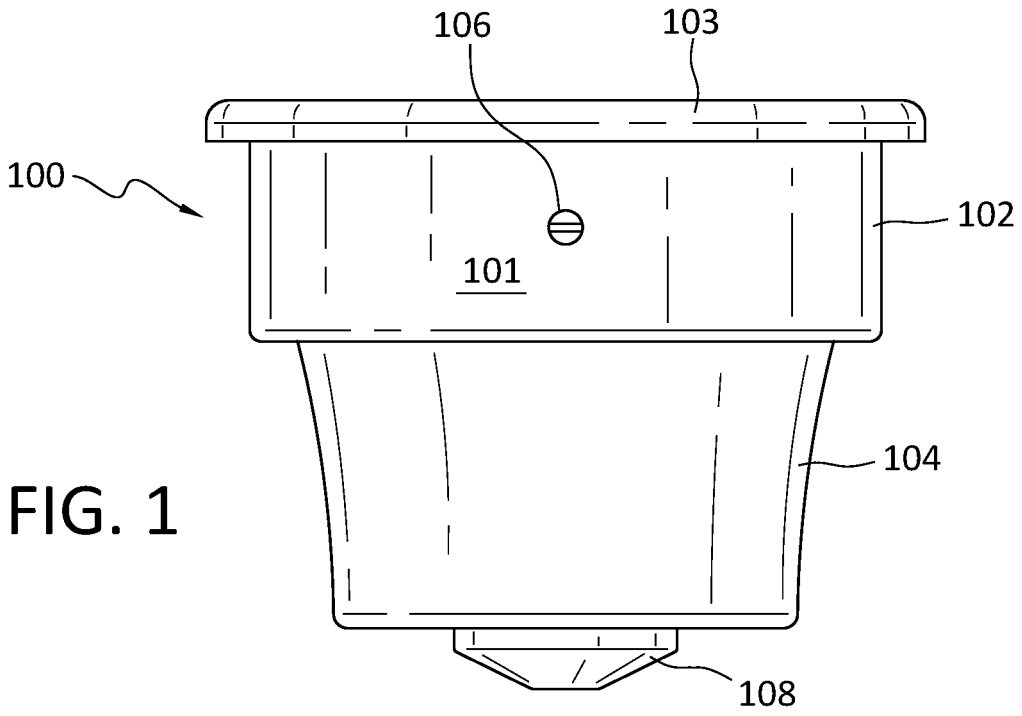
FIG. 1 is a side elevational view of a new and improved cup holder assembly, as constructed and developed in accordance with the principles and teachings of the present invention, wherein the cup holder assembly is shown in a vertical state or orientation.
Figure 2:
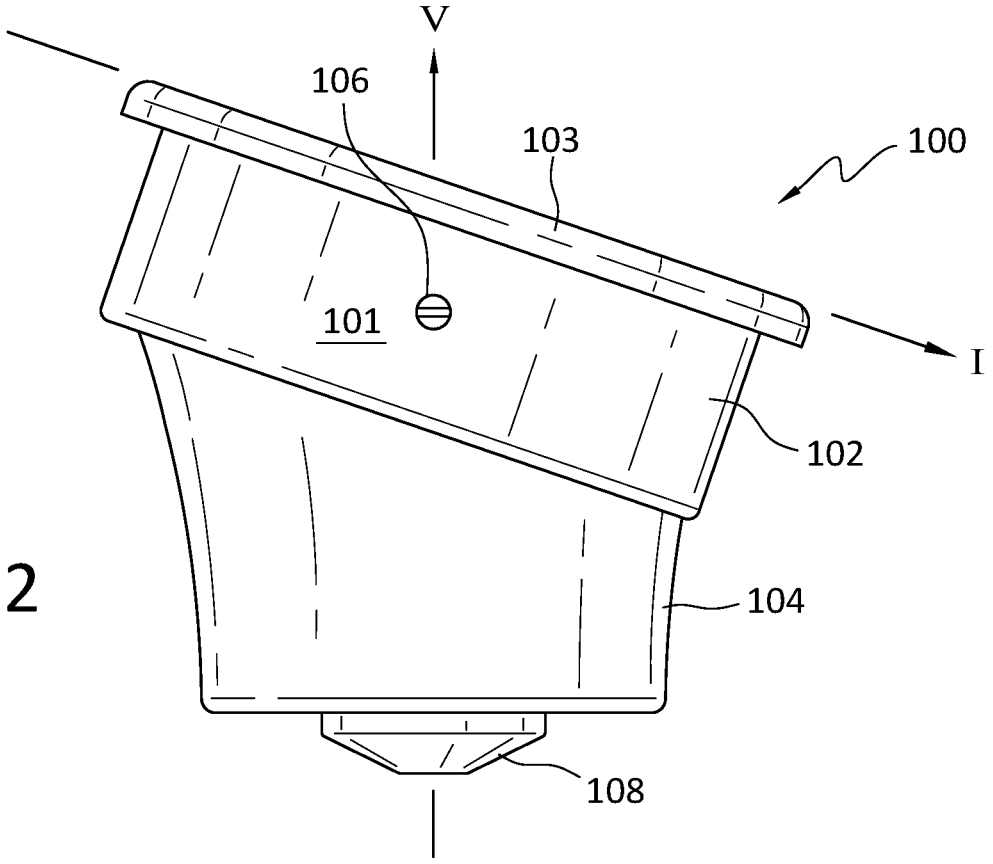
FIG. 2 is a side elevational view of the new and improved cup holder assembly, as illustrated within FIG. 1, wherein the cup holder assembly is shown in a tilted or inclined state.
Figure 3:
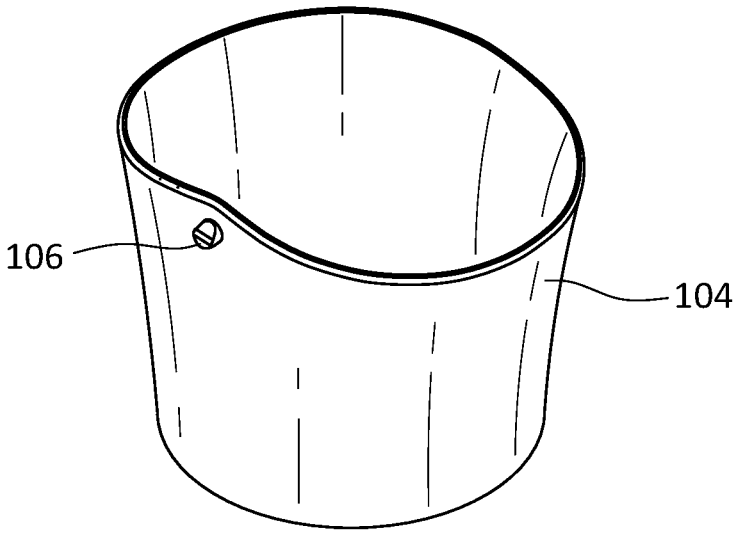
FIG. 3 is a perspective view of the cup holder of the new and improved cup holder assembly of the present invention.
Figure 4:
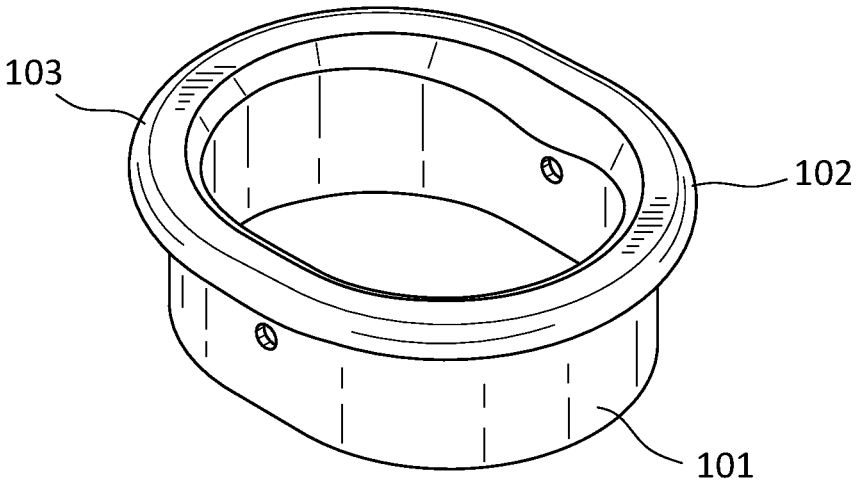
FIG. 4 is a perspective view of the mount or housing of the new and improved cup holder assembly of the present invention.
Figure 5:
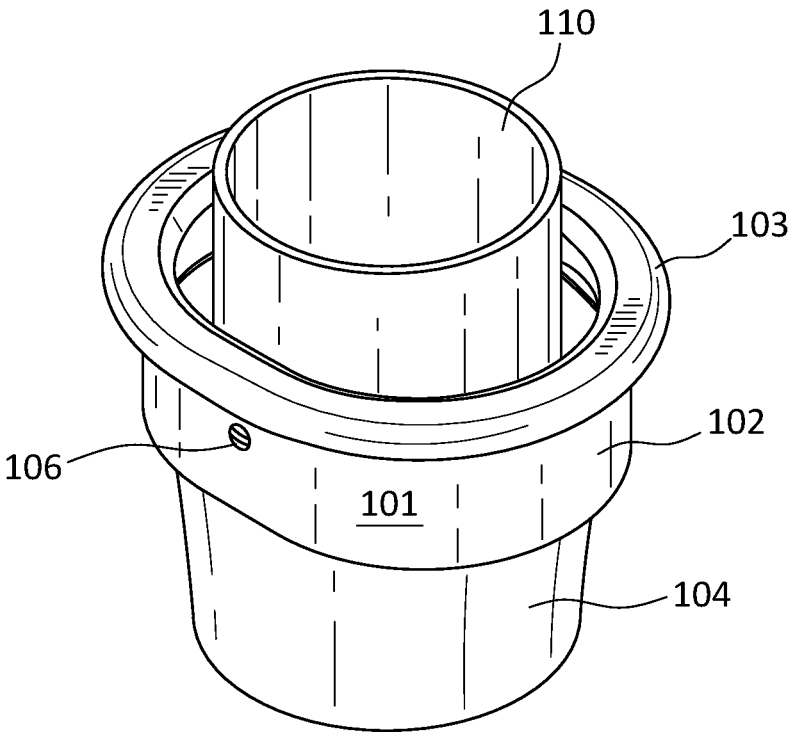
FIG. 5 is a perspective view of the new and improved cup holder assembly of the present invention showing the disposition of a beverage cup within the new and improved cup holder assembly of the present invention when the cup holder assembly is disposed at its normal, upright orientation.
Figure 6:
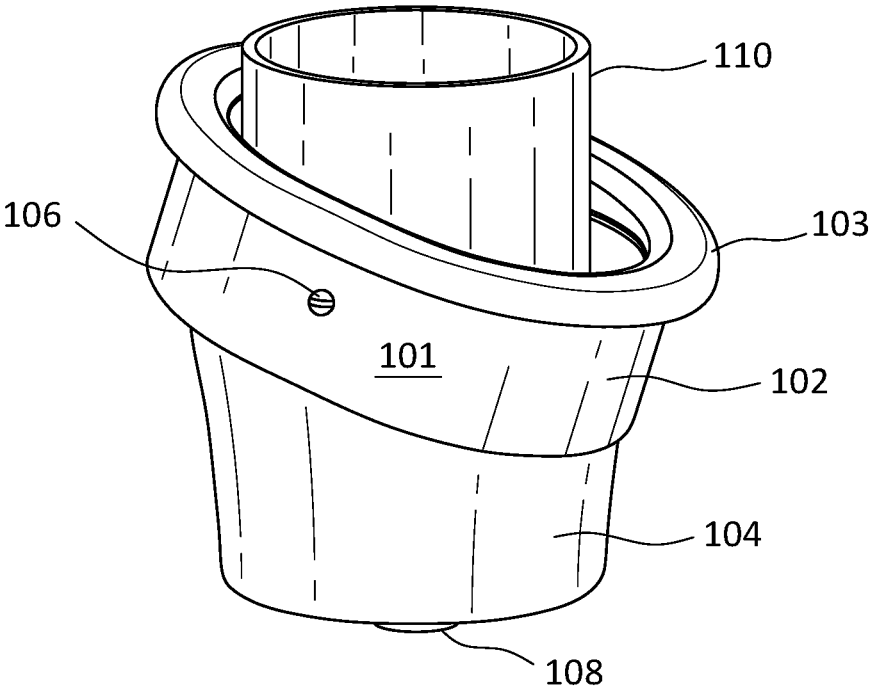
FIG. 6 is a perspective view of the new and improved cup holder assembly of the present invention showing the disposition of a beverage cup within the new and improved cup holder assembly of the present invention when the cup holder assembly is disposed at its inclined orientation.

Referring now to the drawings, a new and improved pivotally mounted cup holder assembly for use within a powered chair or other furniture piece is disclosed and is generally indicated by the reference character 100. More particularly, it is seen that the new and improved pivotally mounted cup holder assembly 100 comprises a cupholder mount or housing 102 which is adapted to be fixedly mounted within an arm or armrest portion of a powered chair or other furniture piece 200, shown in FIG. 7, and wherein a cupholder 104 is pivotally mounted upon the cupholder mount or housing 102 by means of a pair of oppositely disposed pivot pins or axles 106. The cupholder mount or housing 102 is seen to comprise a body portion 101 which is adapted to be fixedly mounted or embedded within at least one of the arm or armrest portions of the powered chair or other furniture piece 200, and a circumferential flange portion 103 which is adapted to sit atop or engage an upper surface portion of the arm or armrest portion of the powered chair once the cupholder mount or housing 102 has been fixedly mounted or embedded within at least one of the arm or armrest portions of the powered chair or other furniture piece 200. The cupholder 104 is provided with a counterweight 108, which is fixedly mounted or attached to a bottom, lower end, or underside portion of the cupholder 104, and is also adapted to receive a beverage cup 110 as can best be seen in FIGS. 5 and 6. Accordingly, it can be appreciated that when the powered chair or other powered furniture piece 200 is inclined, such as, for example, when the powered chair or furniture piece 200 is moved from its normal upright position to an inclined or reclined position, the arm or armrest portions 212,214 of the powered chair or furniture piece 200, and the cupholder mount or housing 102 fixedly mounted within at least one of the arm or armrest portions 212,214 of the chair or furniture piece 200, will likewise be inclined. However, the counterweight 108 of the cupholder 104 will effectively cause or force the cupholder 104 to maintain a vertical orientation whereby the beverage cup 110, disposed within the cupholder 104, will likewise maintain a vertical orientation such that the contents of the beverage cup 110 will not be spilled. This can be especially appreciated from FIG. 2 wherein the inclined orientation of the cupholder mount or housing 102 has been schematically indicated by means of the inclined reference plane I while the vertical orientation of the cupholder 104 has been schematically indicated by means of the vertical reference plane V.

Figure 7:
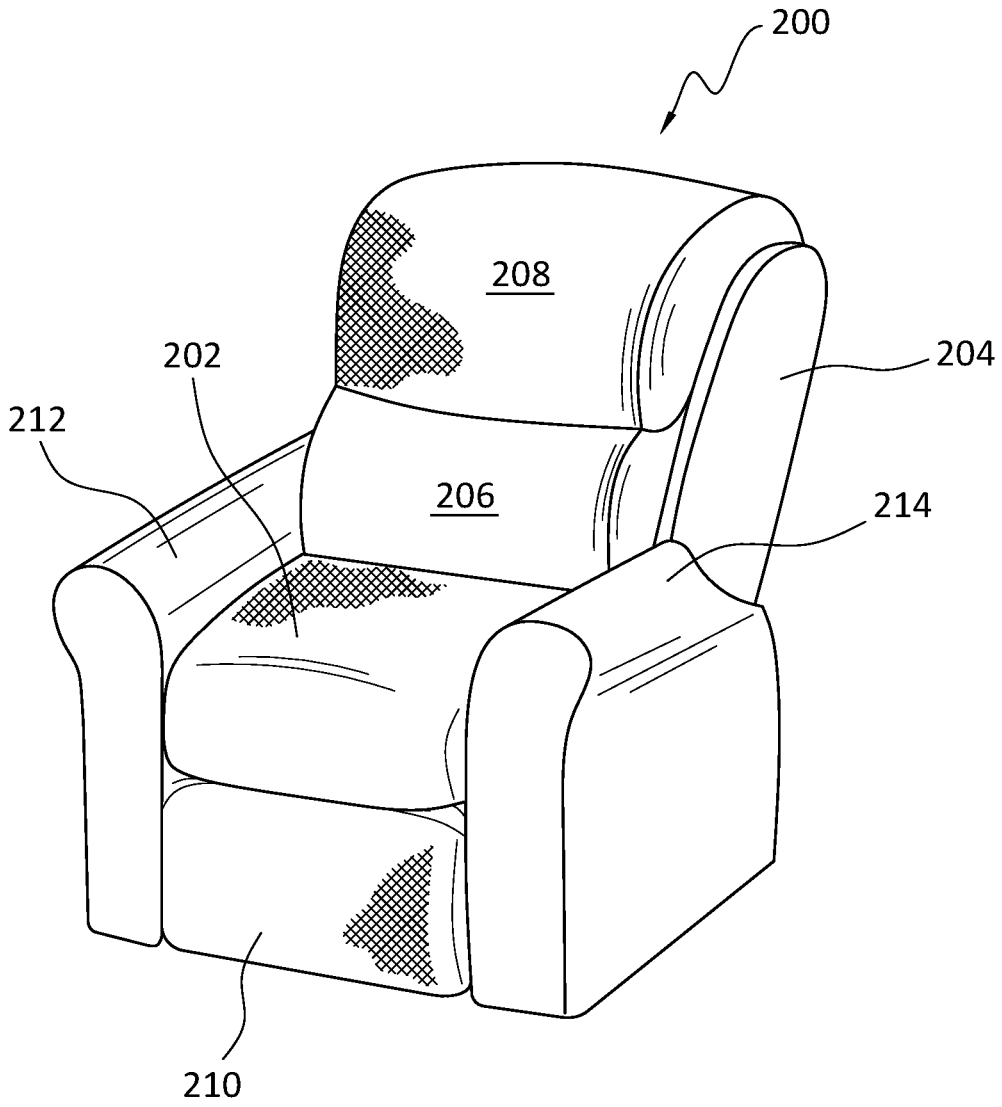
FIG. 7 (PRIOR ART)
FIG. 7 is a front, right side perspective view of a conventional PRIOR ART powered chair within at least one of the arm or armrest portions of which the new and improved cup holder assembly of the present invention can be incorporated.

With reference now being made to FIG. 7, a conventional PRIOR ART powered chair, generally indicated by the reference character 200 and within which the new and improved pivotally mounted cup holder assembly 100 can be incorporated within at least one of the arm portions of the chair 200, is seen to comprise a typical lounger chair which comprises a seat portion 202, a back portion 204 which may be moved between various positions between an upright position and a fully reclined position, a lumbar support portion 206 which is effectively part of the back portion 204 but which is positionally located so as to be capable of engaging the lumbar region of the back of the torso of the person seated in the chair 200, a headrest portion 208 which may be moved to various positions as desired by a person seated in the chair 200 such that the headrest portion 208 is disposed at a position that the person seated in the chair 200 finds most comfortable. In addition, the chair 200 further comprises a footrest portion 210 which, in a manner similar to that of the headrest portion 208, may be moved to various positions as desired by a person seated in the chair 200 such that the footrest portion 210 is disposed at a position that the person seated in the chair 200 finds most comfortable. Typical positions can include positions between fully retracted and fully extended. Lastly, the chair 200 comprises a pair of oppositely disposed armrest portions 212,214.

Having described substantially all of the structural components comprising the new and improved pivotally mounted cup holder assembly 100 of the present invention, a brief operation of the same will now be described. More particularly, when the powered chair or other powered furniture piece 200 is moved from its normal upright position to an inclined or reclined position, the arm or armrest portions 212,214 of the powered chair or furniture piece 200, as well as the cupholder mount 102 fixedly mounted within at least one of the arm or armrest portions 212,214 of the chair or furniture piece 200, will likewise be inclined such that they will be disposed along the inclined plane I schematically illustrated within FIG. 2, however, the counterweight 108 of the cupholder 104 will effectively cause or force the cupholder 104 to maintain a vertical orientation, as schematically illustrated by means of the vertical plane orientation V in FIG. 2, whereby the beverage cup 110, disposed within the cupholder 104, will likewise maintain a vertical orientation such that the contents of the beverage cup 110 will not be spilled.

Obviously, many variations and modifications of the present invention are possible in light of the above teachings. It is therefore to be understood that within the scope of the appended claims, the present invention may be practiced otherwise than as specifically described herein.

What is claimed, and is desired to be secured by Letters Patent, is:

1. A cup holder assembly for use within a powered furniture piece capable of being moved between upright and inclined positions, comprising:

a cupholder housing comprising a body portion adapted to be fixedly mounted within an arm portion of a powered furniture piece, and an annular flange adapted to sit atop or engage an upper surface portion of the arm portion of the powered furniture piece once said cupholder housing has been fixedly mounted within the arm portion of the powered furniture piece;

a cupholder pivotally mounted upon said cupholder housing and adapted to contain a beverage cup; and a counterweight fixedly attached to said cupholder for causing said cupholder to freely pivot toward a vertical orientation, relative to said cupholder housing, regardless of any inclination of the arm portion of the powered furniture piece when the furniture piece is moved to an inclined position, whereby when the powered furniture piece is moved to an inclined position, said counterweight will maintain said cupholder within a vertical orientation such that a beverage, contained within the beverage cup, will not spill.

2. The cupholder assembly as set forth in claim 1, wherein:

said cupholder is pivotally mounted upon said cupholder housing by a pair of oppositely disposed pivot pins.

3. The cupholder assembly as set forth in claim 1, wherein:

said counterweight is fixedly attached to a lower end portion of said cupholder.

4. The cupholder assembly as set forth in claim 1, wherein:

said counterweight is fixedly attached to a bottom portion of said cupholder.

5. The cupholder assembly as set forth in claim 1, wherein:

said counterweight is fixedly attached to an underside portion of said cupholder.

6. A powered furniture piece capable of being moved between upright and inclined positions, and having a cupholder assembly fixedly mounted within an arm portion of said chair, said cupholder assembly comprising:

a cupholder housing comprising a body portion adapted to be fixedly mounted within an arm portion of a powered furniture piece, and an annular flange adapted to sit atop or engage an upper surface portion of the arm portion of the powered furniture piece once said cupholder housing has been fixedly mounted within the arm portion of the powered furniture piece;

a cupholder pivotally mounted upon said cupholder housing and adapted to contain a beverage cup; and a counterweight fixedly attached to said cupholder for causing said cupholder to freely pivot toward a vertical orientation, relative to said cupholder housing, regardless of any inclination of the arm portion of the powered furniture piece when the furniture piece is moved to an inclined position, whereby when the powered furniture piece is moved to an inclined position, said counterweight will maintain said cupholder within a vertical orientation such that a beverage, contained within the beverage cup, will not spill.

7. The powered furniture piece as set forth in claim 6, wherein:

said cupholder is pivotally mounted upon said cupholder housing by a pair of oppositely disposed pivot pins.

8. The powered furniture piece as set forth in claim 6, wherein:

said counterweight is fixedly attached to a lower end portion of said cupholder.

9. The powered furniture piece as set forth in claim 6, wherein:

said counterweight is fixedly attached to a bottom portion of said cupholder.

10. The powered furniture piece as set forth in claim 6, wherein:

said counterweight is fixedly attached to an underside portion of said cupholder.

11. The powered furniture piece as set forth in claim 6, wherein:

said powered furniture piece comprises a powered chair.

* * * * *